US005084330A

United States Patent [19]

Koshizuka et al.

[11] Patent Number: 5,084,330

[45] Date of Patent: Jan. 28, 1992

[54] THERMAL TRANSFER RECORDING MEDIUM

[75] Inventors: Kunihiro Koshizuka; Toshiaki Tezuka; Harue Ebisawa; Takao Abe, all of Hino, Japan

[73] Assignee: Konica Corporation, Tokyo, Japan

[21] Appl. No.: 353,100

[22] Filed: May 17, 1989

[30] Foreign Application Priority Data

May 18, 1988 [JP] Japan ..... 63-121621
Jun. 15, 1988 [JP] Japan ..... 63-149198

[51] Int. Cl.[5] ..... B41M 5/26

[52] U.S. Cl. ..... 428/212; 428/195; 428/336; 428/522; 428/913; 428/914

[58] Field of Search ..... 428/195, 484, 488.1, 428/488.4, 913, 914, 212, 336, 522

[56] References Cited

U.S. PATENT DOCUMENTS 4,623,580 11/1986 Koshizuka et al. ..... 428/488.4
4,732,815 3/1988 Mizobuchi et al. ..... 428/488.4
4,818,591 4/1989 Kitamura et al. ..... 428/488.4

FOREIGN PATENT DOCUMENTS 0235296 9/1987 European Pat. Off. ..... 428/488.4
0263478 4/1988 European Pat. Off. ..... 428/488.4

OTHER PUBLICATIONS

Patent Abstracts of Japan, vol. 13, No. 327 (M-554)(3675) 24 Jul. 1989, & JP-A-01 110186 (Hitachi Maxell Limited) 26 Apr. 1989, * the whole document *.

Patent Abstracts of Japan, vol. 11, No. 213 (M-605)(2660) 10 Jul. 1987, & JP-A-62 30080 (Seiko Epson Corporation) 9 Feb. 1987, * the whole document *.

Patent Abstracts of Japan, vol. 11, No. 157 (M-590)(2604) 21 May 1987, & JP-A-61 287790 (Seiko Epson Corporation) 18 Dec. 1986, * the whole document *.

Patent Abstracts of Japan, vol. 11, No. 125 (M-582)(2572) 18 Apr. 1987, & JP-A-61 268488 (Seiko Epson Corporation) 27 Nov. 1986, * the whole document *.

Patents Abstracts of Japan, vol. 10, No. 304 (M-526)(2360) 16 Oct. 1986, & JP-A-61 116592 (Carbon Paper K.K.) 4 Jun. 1986, * the whole document *.

*Primary Examiner*—Pamela R. Schwartz
*Attorney, Agent, or Firm*—Frishauf, Holtz, Goodman & Woodward

[57] ABSTRACT

A thermal transfer recording medium comprising a support having thereon a first heat softening layer and a second softening layer is disclosed. In the medium the first softening layer contains a heat-fusible substance, and the second heat softening layer contains a resin having a melt index value of 2-1500.

9 Claims, No Drawings

THERMAL TRANSFER RECORDING MEDIUM

BACKGROUND OF THE INVENTION

The present invention relates to a thermal transfer recording medium, in particular, to a thermal transfer recording medium that excels in image definition, characterized in that its adhesion is enough even for a transferee medium of poor smoothness, and, therefore, deposition of printed characters is satisfactory. Even in a high speed printing operation, a heat softening layer is readily transferred from a support onto a transferee medium, thereby high print quality is achieved.

Recently, more common use of the thermal transfer recording apparatuses such as a wordprocessor is entailing more common use of the thermal transfer recording medium comprising a support having thereon a heat softening layer.

However, the conventional thermal transfer recording medium has fundamental problems such as print quality that is readily affected by the smoothness of a transferee medium (e.g. a transfer sheet); poor deposition of printed images; and, and when used at higher printing speed results in disproportionally poor print quality.

To overcome these problems, there have been various attempts for improving deposition of printed images; one attempt is a multilayer heat softening layer on a thermal transfer recording medium; and in another attempt, various additives are incorporated into a heat softening layer.

For example, a heat softening layer of one proposed thermal transfer recording medium comprises two layers, i.e. an intermediate layer and a heat-fusible ink layer, wherein the melting point of the intermediate layer that is adjacent to a support is lower than that of the heat-fusible ink layer disposed above the intermediate layer (Japanese Patent Publication Open to Public Inspection, hereinafter referred to as Japanese Patent O.P.I. Publication, No. 189492/1985).

According to this thermal transfer recording medium, the release of the ink layer from the support is enhanced by the presence of an intermediate layer, thereby the melting point of the heat-fusible ink layer can be higher than that of a thermal transfer recording medium lacking such an intermediate layer and deposition of the resultant printed image is positively improved.

This thermal transfer recording medium, however, provides yet insufficient adhesion relative to a transferee medium: smudge or streaking readily occurs when printing is performed with a transferee medium of poor surface smoothness, or when high speed printing is performed, resulting in degraded print quality.

SUMMARY OF THE INVENTION

The object of the invention is to provide a thermal transfer recording medium that excels in image definition, characterized in that its adhesion is enough even for a transferee medium of poor smoothness, and, therefore, deposition of printed characters is satisfactory; even in a high speed printing operation, a heat softening layer is readily transferred from a support onto a transferee medium, thereby high print quality is achieved.

The present inventor has performed studies and learned that a thermal transfer recording medium comprising a support having thereon a designed first heat softening layer and a designed second heat softening layer provides excellent image definition; and that this transfer medium has satisfactory adhesion relative to a transferee medium of poor surface smoothness, and thereby deposition of printed image is excellent; and that this medium attains high print quality even in a high speed printing operation, since the heat softening layer is readily transferred the support onto the transferee medium.

To sum up, what the invention provides is a thermal transfer recording medium comprising a support having thereon a first heat softening layer and a second heat softening layer in this order, wherein the first heat softening layer at least contains a heat-fusible substance, and the second heat softening layer at least contains an ethylene-vinyl acetate copolymer (or a derivative thereof) whose vinyl acetate content being not less than 28 wt % and/or an ethylene-ethyl acrylate copolymer (or a derivative thereof) whose ethyl acrylate content being not less than 28 wt %, or saturated linear polyester of which softening point is 50° to 100° C.

A thermal transfer recording medium of the invention comprises a support having thereon at least a first heat softening layer and a second heat softening layer in this order. A thermal transfer recording medium of the invention may have other layers as far as these layers do not hinder the intended properties of the recording medium of the invention. In other words, the first heat softening layer may be formed on the support via another layer such as a stripping layer; and below the second heat softening layer may be provided an intermediate layer or the like.

DETAILED DESCRIPTION OF THE INVENTION

Next, the constitution of a thermal transfer recording medium of the invention is hereunder described in the order of a support, a first heat softening layer, and a second heat softening layer.

Support

A preferred support for a thermal transfer recording medium of the present invention is a high heat resistant support of good dimensional stability.

Examples of a material for forming the support include paper such as normal paper, condenser paper, and laminated or coated paper; a resin film made such as of polyethylene, polyethylene terephthalate, polystyrene, polypropylene and polyimide; a combination of paper and resin film; and a metal sheet of aluminum foil, etc.

The thickness of the support is usually not more than 30 μm, or, preferably, within a range of 2 to 30 μm. A thickness of the support, in excess of 30 μm, may deteriorate thermal conductivity, and, thus, poor print quality.

The thermal transfer recording medium of the invention may have arbitrary constitution with the other side of the support; the other side of the support may have a backing layer such as an anti-sticking layer.

The first heat softening layer described below is formed directly on a support, or via a conventionally known stripping layer or anchoring layer.

First heat softening layer

One essential aspect of the present invention is to dispose, between the support and a second heat softening layer described below, a first heat softening layer that at least contains a heat-fusible substance.

A first heat softening layer according to the invention is readily stripped off a support, and improves printing efficiency of a thermal transfer recording medium of the invention during a high speed printing operation.

This operation of the first heat softening layer is primarily attributable to the heat-fusible substance above contained in the first heat softening layer.

Typical examples of the heat-fusible substance include vegetable waxes such as carnauba wax, Japan wax, auriculae wax, and esparto wax; animal waxes such as beeswax, insect wax, shellac wax, and spermaceti wax; petroleum waxes such as paraffin wax, microcrystaline wax, polyethylene wax, ester wax, and acid wax; mineral waxes such as montan wax, ozokerite, and cerecine. Other examples include higher fatty acids such as palmitic acid, stearic acid, margaric acid, and behenic acid; higher alcohols such as palmityl alcohol, stearyl alcohol, behenyl alcohol, marganyl alcohol, myricyl alcohol, and eicosanol; higher fatty acid esters such as cetyl palmitate, myricyl palmitate, cetyl stearate, and myricyl stearate; amides such as acetamide, propionic amide, palmitic amide, stearic amide, and amide wax; higher amines such as stearyl amine, behenyl amine, and palmityl amine.

These substances can be used singly or in combination.

Those preferable among these examples are waxes whose melting points range from 50° to 100° C., wherein the melting points are measured by Yanagimoto Model MJP-2.

The content ratio of a heat fusible substance in the first heat softening layer is usually 5 to 95 wt %, or, preferably, 50 to 90 wt %, in particular, 60 to 80 wt % per total amount of components that constitute the first heat softening layer.

The first heat softening layer may contain a thermoplastic resin in addition to the heat-fusible substance.

Typical examples of the heat-fusible substance include resins such as ethylene copolymers, polyamide resins, polyester resins, polyurethane resins, polyolefin resins, acrylic resins, vinyl chloride resins, cellulose resins, rosin resins, ionomer resins and petroleum resins; elastomers such as natural rubber, styrene-butadiene rubber, isoprene rubber, chloroprene rubber and diene copolymers; rosin derivatives such as ester gum, rosin maleic acid resins, rosin phenol resins and hydrogenated rosin resins; high molecular compounds having a melting point of 50° to 150° C., such as phenol resins, terpene resins, cyclopentadiene resins, and aromatic hydrocarbon resins.

Those especially advantageous among the above examples are acrylic resins, diene copolymers, and ethylene copolymers. Using any of these resins provides a thermal transfer recording medium that excels especially in high speed print quality.

The preferred thermoplastic resins are hereunder described.

The examples of the acrylic resin include an acrylic resin obtained by polymerizing a monobasic carboxylic acid such as (meth)acrylic acid or ester thereof with at least one compound being capable of copolymerizing with the former.

The examples of the carboxylic acid or ester thereof include (meth)acrylic acid, methyl (meth)acrylate, ethyl (meth)acrylate, isopropyl (meth)acrylate, butyl (meth)acrylate, isobutyl (meth)acrylate, amyl (meth)acrylate, hexyl (meth)acrylate, octyl (meth)acrylate, 2-ethylhexyl (meth)acrylate, decyl (meth)acrylate, dodecyl (meth)acrylate, hydroxyethyl (meth)acrylate, and hydroxyethyl (meth)acrylate.

The examples of the above-mentioned copolymerizable compound include vinyl acetate, vinyl chloride, vinilidene chloride, maleic acid anhydride, fumaric acid anhydride, styrene, 2-methylstyrene, chlorostyrene, acrylonitrile, vinyltoluene, N-methylol (meth)acrylamide, N-butoxymethyl (meth)acrylamide, vinylpyridine, and N-vinylpyrrolidone; these examples can be used singly or in combination.

The examples of the diene copolymer include butadiene-styrene copolymers, butadiene-styrene-vinylpyridine copolymers, butadiene-acrylonitrile copolymers, chloroprene-styrene copolymers, and chloroprene-acrylonitrile copolymers.

The examples of the ethylene copolymer include ethylene-vinyl acetate copolymers, ethylene-ethyl acrylate copolymers, ethylene-methyl methacrylate copolymers, ethylene-isobutyl acrylate copolymers, ethylene-acrylic acid copolymers, ethylene-vinyl alcohol copolymers, ethylene-vinyl chloride copolymers, and ethylene-acrylic acid metal-salt copolymers.

These substances may be used either singly or in combination of two or more.

The content ratio of a thermoplastic resin in the first heat softening layer is usually 0.3 to 4.0 wt %, or, preferably, 0.5 to 3.0 wt %, in particular, 0.8 to 2.5 wt % per total amount of components in the same layer.

The first heat softening colorant layer of the thermal transfer recording medium of the invention may contain a surfactant such as a polyoxyethylene-chained compound, other than the above-mentioned components, in order to adjust strippability of the same layer.

The first heat softening colorant layer may also contain organic or inorganic fine powder (metal powder, silica gel or the like) or oil (linsseed oil, mineral oil or the like).

The first heat softening layer of the thermal recording medium of the invention may contain a colorant.

The examples of the colorant mentioned above include inorganic and organic pigments, and dyes.

The examples of the inorganic pigment include titanium dioxide, carbon black, zinc oxide, prussian blue, cadmium sulfide, and iron oxide; chromates of lead, zinc, barium, and calcium.

The examples of the organic pigment include azo, thioindigo, anthraquinone, anthoanthrone, and triphenonedioxazine, vat dye pigments, and phthalocyanine pigments such as copper phthalocyanine pigment and its derivatives, and quinacridon pigment.

The examples of the dyes mentioned above include acid dyes, direct dyes, disperse dyes, oil soluble dyes, and metal complex oil soluble dyes.

When the first heat softening layer contains the colorant, the content ratio of the colorant per total amount of components in the same layer is usually within a range of 5 to 30 wt %, or, preferably, within 10 to 25 wt %.

The first heat softening layer is formed by a coating process such as a hot-melt coating process, an aqueous coating process, and a coating process using an organic solvent.

The thickness of the so-formed first heat softening layer is usually within a range of 0.6 to 8.0 μm, or, preferably, within a range of 1.0 o 5.0 μm.

On the so-formed first heat softening layer is formed a second heat softening layer described below directly or via a layer such as an intermediate layer.

Second heat softening layer

Another essential aspect of the present invention is to dispose a second heat softening layer directly on the first heat softening layer or via another layer such as an intermediate layer, wherein the second heat softening layer at least contains an ethylene-vinyl acetate copolymer (or a derivative thereof) whose vinyl acetate content being not less than 28 wt % and/or an ethylene-ethyl acrylate copolymer (or a derivative thereof) whose ethyl acrylate content being not less than 28 wt %.

A second heat softening layer according to the invention has high adhesive power even with a transferee medium of poor surface smoothness as in the case of a rough paper, thereby printed image excels in deposition and a high quality printed image is formed.

This operation of the second heat softening layer is primarily attributable to the ethylene-vinyl acetate copolymer (or a derivative thereof) and/or the ethylene-ethyl acrylate copolymer (or a derivative thereof) [such components are hereunder referred to from time to time as resin components (a)] each contained in the same layer.

Once the second heat softening layer is heated by, for example, a thermal head of a thermal printer, the resin component (a) above softens the second heat softening layer and improves the adhesion of the same layer to a transferee medium.

Still another essential aspect of the present invention is that the second heat softening layer contains the ethylene-vinyl acetate copolymer (or a derivative thereof) whose vinyl acetate content being not less than 28 wt % and/or the ethylene-ethyl acrylate copolymer (or a derivative thereof) whose ethyl acrylate content being not less than 28 wt %, whereby the second heat softening layer is softener than a similar layer otherwise composed. This arrangement improves the adhesion of the same layer to a transferee medium and enhances deposition of printed image.

The resin component (a) fails to fully exhibit its operation mentioned above, if a vinyl acetate content in the ethylene-vinyl acetate copolymer (or a derivative thereof) or an ethyl acrylate component in the ethylene-ethyl acrylate copolymer (or a derivative thereof) is less than 28 wt %. In this case, the performance especially in the form of the deposition relative to a transferee medium required of the second heat softening layer of a thermal recording medium of the invention is not fully attained.

The ethylene-vinyl acetate copolymer useful in embodying the present invention is not limited to a specific scope, as far as its vinyl acetate content is not less than 28 wt %, and examples of which are as follows: an ethylene-vinyl acetate copolymer (EVA) that is obtained by reacting ethylene with vinyl acetate in the presence of an organic peroxide or oxygen; or a graft modified terpolymer that is obtained by adding a catalyst, alcohol and unsaturaged carboxylic acid to the EVA as a starting material, so as to subjects the EVA to chemical reaction.

Likewise, the ethylene-ethyl acrylate copolymer useful in embodying the present invention is not limited to a specific scope, as far as its vinyl acetate content is not less than 28 wt %, and examples of which are an ethylene-ethyl acrylate copolymer (EEA) that is obtained by polymerizing ethylene with ethyl acrylate, and derivatives of the EEA.

According to this the embodiment of the invention, the resin components (a) may be used either singly or in combination of two or more. The resin components (a) appropriate for single use are ethylene-vinyl acetate copolymers or derivatives thereof whose vinyl acetate content is not less than 33 wt % and not more than 50 wt %, and ethylene-ethyl acrylate copolymers whose ethyl acrylate content is not more than 33 wt % and not more than 50 wt %. Preferred combinations for the combined use include one comprising an ethylene-vinyl acetate copolymer (or a derivative thereof) whose vinyl acetate content being not less than 28 wt % and not more than 50 wt % and ethylene-ethyl acrylate copolymer (or a derivative thereof) whose ethyl acrylate content being not less than 28 wt % and not more than 50 wt %.

A melt index (MI) of the resin component (a) preferably used in embodying the invention is usually within a range of 2 to 1500, or, preferably, 20 to 500.

The content ratio of the resin component (a) in the second heat softening layer is usually within a range of 5 to 100 wt %, or, preferably, within a range of 30 to 100 wt %.

Use of the resin component (a) whose MI value being within the above range enhances the adhesion of a second heat softening layer to a transferee medium to a satisfactory level.

Another embodiment of the present invention is that the second heat softening layer is formed directly on the first heat softening colorant layer mentioned above or via a layer such as an intermediate layer, wherein the second heat softening layer at least contains a saturated linear polyester whose softening point being 50° to 100° C.

The second heat softnening layer according to the invention allows formation of a positively deposited, high quality printed image even on a resin transferee medium such as an OHP sheet, and also allows formation of high quality printed image even in a high speed printing operation.

This capability of the overcoating layer is primarily attributable to a saturated linear polyester of a softening point of 50° to 100° C. being contained in the same layer.

A saturated linear polyester compound of a softening point lower than 50° C. in an overcoating layer may deteriorate shelf life of a thermal recording medium having the same second heat softening layer; a saturated linear polyester compound of a softening point higher than 100° C. may deteriorate deposition of printed image onto an OHP sheet.

An unsaturated linear polyester contained in an overcoating layer may deteriorate deposition of printed image onto an OHP sheet and, at the same time, deteriorate print quality.

Preferred saturated linear polyesters are not limited to a specific scope as far as their softening points range from 50° to 100° C., and typical examples of which are polyesters such as glyptal resins, isophthal resins, terephthal resins, polyallylate and aliphatic polyesters.

Among these examples, the preferred are linear polyesters (and derivatives thereof) that have an ester bond (—CO—O—) on the principal chain and are solid at a normal temperature, and the particularly preferred is polyester wax.

The polyester wax according to the invention is a similar compound having within one molecule three or more ester bonds (—CO—O—), and whose weight average molecular weight (Mw) is within a range of 1500 to 12000.

Such a compound is available as a condensation polymer of a multivalent alcohol and a multibasic acid or as an open-ring polymer of a lactone compound.

Preferred typical examples of the polyester wax are as follows:

(1) Condensation polymer of an adipic acid and a 1,4-butanediol (Mw=2000; softening point, 55° C.)

(2) Open-ring polymer (Mw=4000, softening point, 60° C.) of ϵ-caprolactone below;

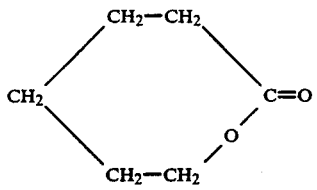

(3) Sebacic acid-decamethylene glycol copolymer (Mw=3000)

(4) Adipic acid-propyrene glycol copolymer (Mw=3000)

(5) ω-hydroxydecanic acid polymer (Mw=4000)

(6) δ-valerolactone polymer (Mw=4000)

A polyester wax preferably used for embodying the present invention may be a compound having within its molecular structure a similar polyester in the form of block or graft polyester; or, otherwise, may be a similar polyester whose end group being an alkyl or amide group. Optionally, a similar polyester may have one or more hydroxy group, amino group, carboxyl group or carbonyl group; or, otherwise, may be a similar polyester having an ether bond, amide bond or urethane bond on the principal or side chain.

The polyester wax is not limited only to those synthesized from a dibasic acid and a divalent alcohol, or a multibasic acid and a multivalent alcohol, each described previously; the polyester was may be synthesized from another dibasic acid and another divalent alcohol, or another multibasic acid and another multivalent alcohol.

The polyester wax is also commercially available, typically as Pracsel (commercial name, Daicel Chemical Industries Ltd.) and as Erythell (commercial name, Unitika Ltd.)

The weight average molecular weight (Mw) of the polyester compound preferably used in embodying the present invention is usually within a range of 1000 to 70000, or, preferably, within a range of 2000 to 20000.

The content ratio of the polyester compound in the overcoating layer is usually within a range of 5 to 100 wt %, or, preferably, within a range of 10 to 90 wt %.

These polyester compounds may be used either singly or in combination of two or more.

The overcoating layer may contain, in addition to the polyester compounds, other components such as a heat-fusible substance and a thermoplastic resin.

Still another embodiment of the present invention is that the second heat softening layer is formed directly on the first heat softening colorant layer or via a layer such as an intermediate layer, wherein the second heat softening layer at least contains a solid silicone-modified resin.

The second heat softening layer according to the invention not only improves shelf life of the thermal transfer recording medium, but also prevents occurrence of streaking of a printed image, thereby enables formation of a printed image of good sharpness.

This capability of the second heat softening layer is primarily attributable to a solid silicone-modified resin in the same layer.

Examples of such a solid-silicone modified resin include a silicone-modified acrylic resin, a silicone-modified urethane resin, a silicone-modified urea resin and a silicone-modified epoxy resin.

These silicone-modified resins are obtained by modifying an acrylic resin, a urethane resin, a urea resin, an epoxy resin and the like by using a polysiloxane. The silicone-modified resins obtained by the above-mentioned modification may be any of graft copolymers, random copolymers and block copolymers.

Typical examples of the silicone-modified acrylic resin are as follows:

Condensation products obtained by reacting an organopolysiloxane represented by Formula (1) below;

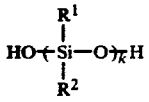

(1)

wherein $R^1$ and $R^2$ independently represent a monovalent aliphatic hydrocarbon or phenyl group having 1 to 10 carbon atoms, or a monovalent halogenated hydrocarbon group; k represents an integer, 1 or larger; $R^1$ and $R^2$ may be identical or different with each other;

with an acrylic compound represented by Formula (I) below;

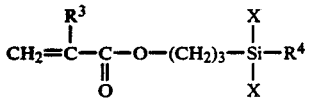

(I)

wherein $R^3$ represents a hydrogen atom or a methyl group:

$R^4$ represents a methyl group, an ethyl group or a phenyl group; X represents a chlorine atom, a methoxy group or an ethoxy group:

Condensation products obtained by reacting an organopolysiloxane represented by Formula (1) with an acrylic compound represented by Formula (I) below;

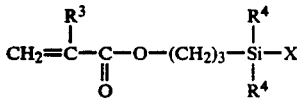

(II)

wherein $R^3$, $R^4$ and X are identical to those already defined;

and/or with an acrylic compound represented by Formula (III) below;

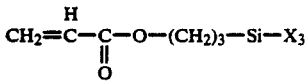

(III)

wherein X is identical to that already defined.

Typical examples of the silicone-modified urethane resin are as follows:

Resins represented by Formula (2) below;

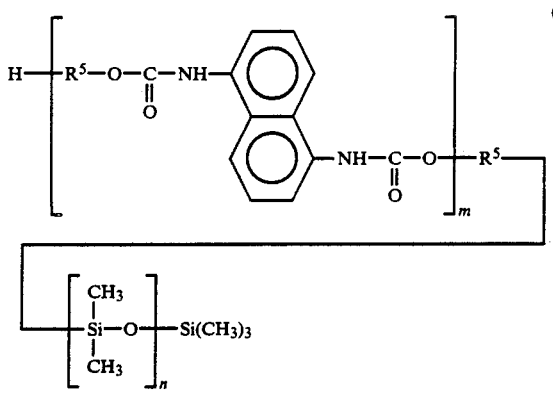

(2)

Resins represented by Formula (3) below;

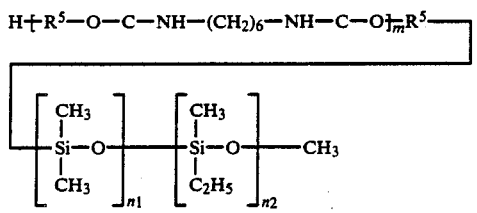

(3)

[in Formulas (2) and (3), m, n, $n_1$ and $n_2$ independently represent an integer, 0 or greater, wherein m and n, or m and $n_1$, and $n_2$, are not simultaneously 0; $R^5$ represents

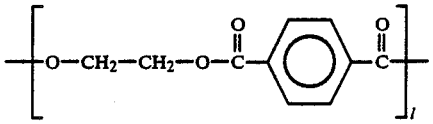

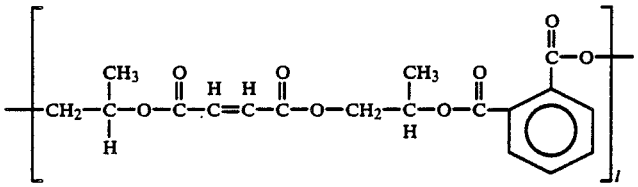

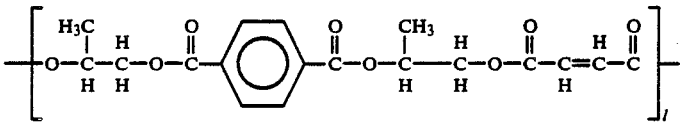

or

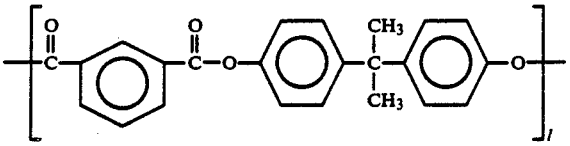

l represents an integer, 1 or larger;

Resins obtained by subjecting a polyurethane polyol represented by Formula (4) below to addition polymerization;

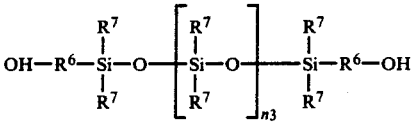

(4)

wherein $R^6$ represents a divalent aliphatic, aromatic or fatty aromatic group, or, preferably, an alkyl group having 1 to 6 carbon atoms or an aromatic group having 6 to 10 carbon atoms; $R^7$ represents an alkyl group having 1 to 6 carbon atoms, or, preferably, a methyl group; $n_3$ is a value to adjust the average molecular weight to a range of 3,000 to 10,000, or, preferably, to a range of approx. 4,000 to 30,000;

with an organic polyisocyanate.

Typical examples of the silicone-modified urea resin include resins obtained by subjecting a polysiloxane polyamine represented by Formula (5) below to addition polymerization;

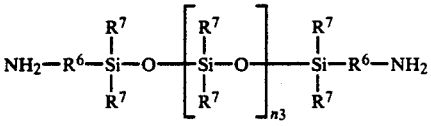

(5)

wherein $R^6$, $R^7$ and $n_3$ are synonymous with those in Formula (4);

with an organic polyisocyanate.

Typical examples of the silicone-modified epoxy resin include resins obtained by modifying an epoxy resin represented by Formula (A) below;

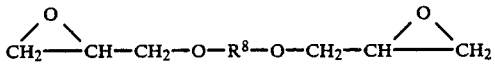

(A)

wherein $R^8$ represents an aliphatic group.

with a silicone intermediate having been converted into a methoxy.

Among these examples, the particularly preferred are a silicone-modified acrylic resin and a silicone-modified urethane resin.

The content ratio of a silicone portion in any of these silicone-modified resins is usually within a range of 1 to 90 wt %, or, preferably, 5 to 50 wt %.

The content ratio of the solid silicone-modified resin in the second heat softening layer is usually within a range of 0.5 to 60 wt %, or, preferably, within a range of 1 to 50 wt % per total amount of components in this layer.

These solid silicone resins may be used either singly or in combination of two or more.

The second heat softening layer may contain, in addition to the solid silicone-modified resin, other components such as a heat-fusible substance and a thermoplastic resin.

The second heat softening layer may, in addition to the resin component (a), a heat-fusible substance, another thermoplastic resin, and a surfactant such as a polyoxyethylene-chained compound.

Preferred examples of these materials are the previously mentioned materials preferably contained in the first heat softening layer.

The second heat softening layer may contain a colorant. Too much content ratio of a colorant in the second heat softening layer may deteriorate the adhesive power of the second heat softening layer relative to a transferee medium, thereby deposition of printed image may be poor when the thermal recording medium of the invention is subjected to a high speed printing operation.

Therefore, if the second heat softening layer contains a colorant, a content ratio of the colorant in the same layer is usually not more than 30 wt %, or, preferably, not more than 25 wt %.

Examples of the colorant possibly contained in the second heat softening layer are same as those possibly contained in the first heat softening layer.

The second heat softening layer is formed directly on the first heat softening layer or via an intermediate layer, by a coating process identical to one being used for forming the first heat softening layer. The particularly advantageous is a process using an organic solvent.

The thickness of the so-formed second heat softening layer is usually within a range of 0.3 to 3 μm, or, preferably, within a range of 0.5 to 2 μm.

Still another embodiment of the present invention is that the second heat softening layer is formed directly on the heat softening colorant layer or via a layer such as an intermediate layer, wherein the overcoating layer contains at least either of an ethylene-acrylic copolymer and an ethylene-alkylacrylic copolymer.

The second heat softening layer according to the invention not only improves deposition of printed image to a metal transferee medium such as aluminum sheet and provides high quality image, but also provides a high quality print even in a high speed printing operation.

This capability of the overcoating layer is primarily attributable to at least either of an ethylene-acrylic copolymer and an ethylene-alkylacrylic copolymer contained in the same layer.

The ethylene-acrylic copolymer may be either a random copolymer or a block copolymer. However, the similar copolymer is preferably a random copolymer.

The blending ratio of the acrylic acid is usually 2 to 90 wt %, or, preferably, 5 to 60 wt % per total amount of the ethylene and the acrylic acid.

The MFR (melt flow rate) of an ethylene-acrylic copolymer preferably used in embodying the invention is usually within a range of 1 to 2000 g/10 min., or, preferably, within a range of 5 to 1000 g/10 min.

The softening point (Vicat softening point) of such an ethylene-acrylic copolymer is 40 to 100° C., or, preferably, 50° to 90° C.

For usual application, a commercially available material, such as Yukalon EAA Series (Mitsubishi Petrochemical Co., Ltd.), is also useful.

The useful ethylene-alkyl acrylic copolymer is not limited to a specific scope; however, a preferred ethylene-alkyl acrylic copolymer has an alkyl group that is represented by R in Formula (I) mentioned previously and has 1 to 4 carbon atoms. More specifically, those particularly preferable are ethylene-methacrylic copolymers and ethylene-butylacrylic copolymers.

Like the ethylene-acrylic copolymer, the ethylene-methacrylic copolymer may be either a random copolymer or a block copolymer; however, a random copolymer is preferred.

The blending ratio of the methacrylic acid is usually 2 to 90 wt %, or, preferably, 5 to 60 wt % per total amount of the ethylene and the methacrylic acid.

The MFR (melt flow rate) of an ethylene-methacrylic copolymer preferably used in embodying the invention is usually within a range of 1 to 500 g/10 min., or, preferably, within a range of 5 to 400 g/10 min.

The softening point (Vicat softening point) of such an ethylene-methacrylic copolymer is 50° to 120° C., or, preferably, 60° to 110° C.

For usual application, a commercially available material, such as Neucrel Series (DuPont), is also useful.

Like the useful ethylene-acrylic copolymer, the useful ethylene-butylacrylic copolymer may be either a random copolymer or a block copolymer; however, a random copolymer is preferred.

The blending ratio of the butylacrylic acid is usually 2 to 95 wt %, or, preferably, 5 to 60 wt % per total amount of the ethylene and the butylacrylic acid.

The MFR (melt flow rate) of an ethylene-butylacrylic copolymer preferably used in embodying the invention is usually within a range of 1 to 2000 g/10 min., or, preferably, within a range of 5 to 1000 g/10 min.

The softening point (Vicat softening point) of such an ethylene-butylacrylic copolymer is 40 to 100° C., or, preferably, 50° to 90° C.

Each of the ethylene-acrylic copolymer, ethylene-methacrylic copolymer and ethylene-butylacrylic copolymer mentioned above may be a copolymer whose hydrogen atoms of the carboxyl group on their molecular chain having been partially substituted with metal atoms such as sodium or zinc atoms.

These copolymers may be used either singly or in combination of two or more.

The overcoating layer may contain, in addition to these copolymers, other components such as a heat-fusible substance and a thermoplastic resin in an amount not hindering the object of the present invention.

Miscellaneous

The thermal transfer recording medium of the present invention may incorporate a known stripping layer or anchoring layer between the support and the first heat softening layer, or an intermediate layer between the first heat softening layer and the second heat softening layer.

On the second heat softening layer may be formed an overcoating layer.

A preferred overcoating layer is a wax layer or polymer layer not containing a colorant.

Once these layers are formed by coating, a recording medium is subjected, according to specific requirements, to a drying process, a surface smoothing process and the like, and then, slit into a required shape, thereby the thermal recording medium of the invention is obtained.

The so-obtained thermal recording medium is used in the form, for example, of a tape or a typewriter ribbon.

The thermal transfer recording technique using the thermal transfer recording medium is not different from a conventional thermal transfer recording technique. The operation of the recording technique is hereunder described by referring to an example where a most typical heat source, thermal head, is used.

First, a heat softening layer of a thermal transfer recording medium is tightly placed on a transferee medium such as a transfer paper, and, according to a requirement, heat pulse is exerted on the rear face of the transfer paper. At the same time, by a thermal head, heat pulse is applied to a portion of the heat softening layer in a pattern that corresponds to a character or pattern being transferred.

The area on the heat softening layer, being heated, readily softens and is transferred onto the transferee medium.

In this course, the first heat softening layer is readily stripped off the support even in a high speed printing operation, since this layer has the previously mentioned heat-fusible substance; at the same time, the second heat softening layer exhibits strong adhesion even to a transferee medium of poor surface smoothness, since this layer has at least the previously mentioned resin component (a), thereby a positively deposited, high quality image is formed.

EXAMPLES

The present invention is hereunder described in detail by referring to examples of the present invention and comparative examples.

EXAMPLE 1

A 3.5 μm thickness polyethylene terephthalate film was coated with the following composition for a first heat softening layer so as to form a first heat softening layer whose dry thickness being 2.0 μm.

The coating process used was a hot melt process using a wire-bar.

| Composition for first heat softening layer | |
|---|---|
| Paraffin wax | 70 wt % |
| Ethylene-vinyl acetate copolymer | 10 wt % |
| Carbon black | 20 wt % |

Next, the first heat softening layer was coated with the following composition for a second heat softening layer so as to form a second heat softening layer whose dry thickness being 1.5 μm. Thus a thermal transfer recording medium of the invention was obtained.

The coating process used was one using an organic solvent (MEK, 35° C.).

| Composition for second heat softening layer | |
|---|---|
| Ethylene-vinyl acetate copolymer (vinyl acetate content, 46 wt %) | 100 wt % |

The so-obtained thermal transfer recording medium was loaded into a commercially available high-speed printer (24 dot serial head; applied energy, 25 mJ/head), and alphabetical characters were transferred onto a lancaster paper (Bekk's smoothness, 2 seconds) in order to evaluate high speed printing properties of the recording medium relative to a rough paper.

The results are summarized in Table 1.

The high speed printing properties were evaluated as follows.

High speed printing properties

A printing operation was performed with the high speed printed under a platen pressure of 350 g/head while varying the printing speed as specified in Table 1, thereby print quality, smudge and streaking of a printed image was visually evaluated. At the same time, deposition of the printed image was evaluated by a stripping test using an adhesive tape (Post-it, Sumitomo 3M).

Symbols in Table 1 are defined as follows.

Printed quality

◎ No voids or blurred areas; excellent edge sharpness

○ No voids or blurred areas

Δ Few voids;

x Many voids; characters not readily legible

Deposition

○ Characters virtually not affected even after the adhesive tape was stripped off Δ Ink partially stripped off x Characters being stripped off

EXAMPLE 2

This example was performed in a manner identical to that of Example 1 except that the composition for second heat softening layer was replaced with the following composition for second heat softening layer.

| Composition for second heat softening layer | |
|---|---|
| Ethylene-vinyl acetate copolymer (vinyl acetate content, 35 wt %) | 80 wt % |
| Carnauba wax (dispersed in MEK) | 20 wt % |

EXAMPLE 3

This example was performed in a manner identical to that of Example 1 except that the composition for second heat softening layer was replaced with the following composition for second heat softening layer.

Results are summarized in Table 1.

| Composition for second heat softening layer | |
|---|---|
| Ethylene-ethyl acrylate copolymer (ethyl acrylate content, 28 wt %) | 90 wt % |
| Methyl methacrylate polymer | 10 wt % |

-continued

| Composition for second heat softening layer |
|---|
| (PMMA) |

EXAMPLE 4

This example was performed in a manner identical to that of Example 1 except that the composition for second heat softening layer was replaced with the following composition for second heat softening layer.

Results are summarized in Table 1.

| Composition for second heat softening layer | |
|---|---|
| Ethylene-vinyl acetate copolymer (vinyl acetate content, 35 wt %) | 50 wt % |
| Ethylene-ethyl acrylate copolymer (ethyl acrylate content, 32 wt %) | 50 wt % |

EXAMPLE 5

This example was performed in a manner identical to that of Example 1 except that the composition for second heat softening layer was replaced with the following composition for second heat softening layer and except that the thickness of the second heat softening layer was changed from 1.5 μm to 0.7 μm.

Results are summarized in Table 1.

| Composition for second heat softening layer | |
|---|---|
| Ethylene-vinyl acetate copolymer (vinyl acetate content, 45 wt %) | 80 wt % |
| Carbon black (dispersed in MEK) | 20 wt % |

EXAMPLE 6

This example was performed in a manner identical to that of Example 1 except that the composition for second heat softening layer was replaced with the following composition for second heat softening layer.

Results are summarized in Table 1.

| Composition for second heat softening layer | |
|---|---|
| Ethylene-vinyl acetate copolymer (vinyl acetate content, 33 wt %) | 100 wt % |

EXAMPLE 7

This example was performed in a manner identical to that of Example 1 except that the composition for second heat softening layer was replaced with the following composition for second heat softening layer.

Results are summarized in Table 1.

| Composition for second heat softening layer | |
|---|---|
| Ethylene-vinyl acetate copolymer (vinyl acetate content, 28 wt %) | 100 wt % |

EXAMPLE 8

This example was performed in a manner identical to that of Example 1 except that the composition for second heat softening layer was replaced with the following composition for second heat softening layer.

Results are summarized in Table 1.

| Composition for second heat softening layer | |
|---|---|
| Ethylene-vinyl acetate copolymer (vinyl acetate content, 41 wt %) | 100 wt % |

EXAMPLE 9

This example was performed in a manner identical to that of Example 1 except that the composition for second heat softening layer was replaced with the following composition for second heat softening layer.

Results are summarized in Table 1.

| Composition for second heat softening layer | |
|---|---|
| Ethylene-vinyl acetate copolymer (vinyl acetate content, 30 wt %) | 100 wt % |

COMPARISON EXAMPLE 1

A thermal transfer recording medium was prepared in a manner identical to that of Example 1 except that the composition for second heat softening layer was replaced with the following composition for second heat softening layer, and then, the so-obtained recording medium was subjected to printing operation with a rough paper in order to evaluate the high speed printing properties of the same medium.

Results are summarized in Table 1.

| Composition for second heat softening layer | |
|---|---|
| Ethylene-vinyl acetate copolymer (vinyl acetate content, 25 wt %) | 100 wt % |

COMPARISON EXAMPLE 2

A thermal transfer recording medium was prepared in a manner identical to that of Example 1 except that the composition for second heat softening layer was replaced with the following composition for second heat softening layer, and then, the so-obtained recording medium was subjected to printing operation with a rough paper in order to evaluate the high speed printing properties of the same medium.

Results are summarized in Table 1.

| Composition for second heat softening layer | |
|---|---|
| Ethylene-vinyl acetate copolymer (vinyl acetate content, 19 wt %) | 100 wt % |

COMPARISON EXAMPLE 3

A thermal transfer recording medium was prepared in a manner identical to that of Example 1 except that the composition for second heat softening layer was replaced with the following composition for second heat softening layer, and then, the so-obtained recording medium was subjected to printing operation with a rough paper in order to evaluate the high speed printing properties of the same medium.

Results are summarized in Table 1.

| Composition for second heat softening layer | |
|---|---|
| Ethylene-vinyl acetate copolymer (vinyl acetate content, 10 wt %) | 100 wt % |

Evaluation

As can be understood from the results in Table 1, the thermal transfer recording medium of the invention provides excellent deposition on a transferee medium of poor surface smoothness such as a lancaster paper even in a high speed printing operation, and loss in print quality with such a transferee medium is apparently smaller.

Effect of the invention

According to the invention a thermal transfer recording medium comprising a support disposed thereon at least a first heat softening layer and a second heat softening layer, wherein the similar recording medium has advantages such as;

(1) since the first heat softening layer at least contains a heat-fusible substance, the recording medium has excellent strippability, thereby response in a high speed printing operation can be greater, and image definition of the same medium is also excellent;

(2) since the second heat softening layer at least contains an ethylene-vinyl acetate copolymer (or a derivative thereof) whose vinyl acetate content being not less than 28 wt % and/or an ethylene-ethyl acrylate copolymer (or a derivative thereof) whose ethyl acrylate content being not less than 28 wt %, the thermal recording medium exhibits sufficient adhesion even to a transferee medium of poor surface smoothness, thereby it forms high quality printed image of excellent deposition;

(3) loss in print quality is small even in a higher speed printing operation, thereby the thermal recording medium is suitable for a high speed printing operation.

TABLE 1

| | Composition for second heat softening layer | | High speed printing properties Printing speed (cps) | | | |
|---|---|---|---|---|---|---|
| | | | 35 | | 70 | |
| | Ethylene-vinyl acetate copolymer or derivative Vinyl acetate content (wt %) | Ethylene-ethyl acrylate copolymer or derivative Ethyl acrylate content (wt %) | Print quality | Deposition | Print quality | Deposition |
| Example 1 | 46 | — | ◎ | ○ | ○ | ○ |
| Example 2 | 35 | — | ◎ | ○ | ○ | ○ |
| Example 3 | — | 28 | ◎ | ○ | Δ | ○ |
| Example 4 | 35 | 32 | ◎ | ○ | ○ | ○ |
| Example 5 | 45 | — | ◎ | ○ | ○ | ○ |
| Example 6 | 33 | — | ◎ | ○ | ○ | ○ |
| Example 7 | 28 | — | ◎ | ○ | ○ | Δ |
| Example 8 | 41 | — | ◎ | ○ | ○ | ○ |
| Example 9 | 30 | — | ◎ | ○ | ○ | Δ |
| Comparative example 1 | 25 | — | ○ | Δ | Δ | x |
| Comparative example 2 | 19 | — | Δ | x | x | x |
| Comparative example 3 | 10 | — | Δ | x | Δ | x |

EXAMPLE 10

A 3.5 μm thickness polyethylene terephthalate film was coated with the following composition for a first heat softening layer so as to form a first heat softening layer whose dry thickness being 2.0 μm.

The coating process used was a hot melt process using a wire-bar.

| Composition for first heat softening layer | |
|---|---|
| Paraffin wax | 65 wt % |
| Ethylene-vinyl acetate copolymer | 15 wt % |
| Carbon black | 20 wt % |

Next, the first heat softening layer was coated with the following composition for a second heat softening layer so as to form a second heat softening layer whose dry thickness being 1.5 μm. Thus a thermal transfer recording medium of the invention was obtained.

The coating process used was one using an organic solvent (MEK, 35° C.)and wire bar.

| Composition for second heat softening layer | |
|---|---|
| Polyester wax [Erythel 8001, product of Unitika Ltd., Softening point: 65° C.] | 100 wt % |

The so-obtained thermal transfer recording medium was loaded into a commercially available printer (24 dot serial head; applied energy, 30 mJ/head), and alphabetical characters were transferred onto an OHP sheet (Sumitomo 3M, OHP sheets) in order to evaluate fixing characteristics and printing image quality of the recording medium relative to an OHP sheet.

The results are summarized in Table 2.

The printing image quality and fixing characteristics were evaluated as follows.

A printing operation was performed under a platen pressure of 700 g/head while varying the printing speed as specified in Table 1, thereby print quality, smudge and streaking of a printed image was visually evaluated. At the same time, deposition of the printed image on the OHP sheet was evaluated by a stripping test using an adhesive tape (Post-it, Sumitomo 3M).

Symbols in Table 2 are same as in Table 1.

EXAMPLE 11

This example was performed in a manner identical to that of Example 10 except that the composition for second heat softening layer was replaced with the following composition for second heat softening layer. Results are summerized in Table 2.

| Composition for second heat softening layer | |
|---|---|
| Polyester wax [Praccel 240, Daisetu Kagaku Co,] | 50 wt % |
| Ethylene-vinyl acetate copolymer | 30 wt % |
| Paraffin wax | 20 wt % |

COMPARISON EXAMPLE 4

A thermal transfer recording medium was prepared in a manner identical to that of Example 11 except that the composition for second heat softening layer was replaced with the following composition for second heat softening layer, and then, the so-obtained recording medium was subjected to printing operation in order to evaluate the printing properties of the same medium.

Results are summarized in Table 1.

| Composition for second heat softening layer | |
|---|---|
| Ethylene-vinyl acetate copolymer | 30 wt % |
| Paraffin wax | 70 wt % |

COMPARISON EXAMPLE 5

A thermal transfer recording medium was prepared in a manner identical to that of Example 11 except that the composition for second heat softening layer was replaced with the following composition for second heat softening layer, and then, the so-obtained recording medium was subjected to printing operation in order to evaluate the printing properties of the same medium.

Results are summarized in Table 1.

| Composition for second heat softening layer | |
|---|---|
| Polyester wax [byron 200, Toyobo, Softening point 160° C.] | 50 wt % |
| Paraffin wax | 20 wt % |
| Ethylene-vinyl acetate copolymer | 30 wt % |

COMPARISON EXAMPLE 6

A thermal transfer recording medium was prepared in a manner identical to that of Example 11 except that the composition for second heat softening layer was replaced with the following composition for second heat softening layer, and then, the so-obtained recording medium was subjected to printing operation in order to evaluate the printing properties of the same medium.

Results are summarized in Table 1.

| Composition for second heat softening layer | |
|---|---|
| Polyester produced with ethylenglycol and terephthalate [Softening point 90° C.] | 50 wt % |
| Paraffin wax | 20 wt % |
| Ethylene-vinyl acetate copolymer | 30 wt % |

As can be understood from the results in Table 2, the thermal transfer recording medium of the invention provides excellent deposition on an OHP sheet, and loss in print quality with such a transferee medium is apparently smaller.

TABLE 2

| | Printing speed (cps) | | | |
|---|---|---|---|---|
| | 35 | | 70 | |
| | image quality | fixing property | image quality | fixing property |
| Example 10 | ○ | ○ | ○ | ○ |
| Example 11 | ○ | ○ | ○ | ○ |
| Comparative 4 | ○ | x | Δ | x |
| Comparative 5 | Δ | Δ | x | x |
| Comparative 6 | Δ | Δ | Δ | x |

What is claimed is:

1. A thermal transfer recording medium comprising a support having thereon a first heat softening layer and a second softening layer in this order, wherein the first softening layer contains a heat-fusible substance, and the second heat softening layer contains a resin having a melt index value of 2-1500 which is an ethylene-ethyl acrylate copolymer whose ethyl acrylate content is not less than 28 wt %.

2. The thermal transfer recording medium according to claim 1 wherein the first heat softening layer contains a coloring agent.

3. The thermal transfer recording medium according to claim 1 wherein the first heat softening layer contains a heat fusible substance having a softening point of 50°-100° C.

4. The thermal transfer recording medium according to claim 1 wherein content ratio of the heat-fusible substance in the first heat softening layer is 5-95 wt %.

5. The thermal transfer recording medium according to claim 1 wherein the first heat softening layer contains a thermoplastic resin.

6. The thermal transfer recording medium according to claim 5 wherein content ratio of the thermoplastic resin in the first heat softening layer is 0.3-4.0 wt %.

7. The thermal transfer recording medium according to claim 1 wherein the second heat softening layer contains a coloring agent.

8. The thermal transfer recording medium according to claim 7 wherein the ratio of the coloring agent in the second heat softening layer is 30 wt %.

9. The thermal transfer recording medium according to claim 1 wherein the thickness of the second heat softening layer is 0.3-3 μm.

* * * * *